US005337662A

United States Patent [19]

Hasegawa

[11] Patent Number: 5,337,662

[45] Date of Patent: Aug. 16, 1994

[54] PRESSURE PRINTING DEVICE

[75] Inventor: Takanori Hasegawa, Tokyo, Japan

[73] Assignee: Riso Kagaku Corporation, Tokyo, Japan

[21] Appl. No.: 69,806

[22] Filed: Jun. 1, 1993

[30] Foreign Application Priority Data

Jun. 3, 1992 [JP] Japan ..... 4-142306

[51] Int. Cl.[5] ..... B05C 17/06; B41F 1/28

[52] U.S. Cl. ..... 101/126; 101/474; 400/625; 118/500; 271/245

[58] Field of Search ..... 101/114, 126, 407.1, 101/474; 400/622, 624, 625, 632, 632.1; 118/500; 271/3, 4, 245

[56] References Cited

U.S. PATENT DOCUMENTS

| | | | |
|---|---|---|---|
| 1,999,959 | 4/1935 | Conus | 101/474 X |
| 2,991,711 | 7/1961 | Ehrhard et al. | 101/126 |
| 4,440,387 | 4/1984 | Ikoma et al. | 271/245 |
| 4,696,228 | 9/1987 | David et al. | 101/126 X |
| 5,028,156 | 7/1991 | Takano | 400/625 |

FOREIGN PATENT DOCUMENTS

| | | | |
|---|---|---|---|
| 1237331 | 6/1971 | United Kingdom | 101/126 |

*Primary Examiner*—Edgar S. Burr
*Assistant Examiner*—Christopher A. Bennett
*Attorney, Agent, or Firm*—Dickstein, Shapiro & Morin

[57] ABSTRACT

A printing paper supporting table having an inclined and adhesive printing paper supporting surface is provided with printing paper peeling plates which can selectively project upward from the printing paper supporting surface and a gate member for preventing the downward movement of the printing paper at a lower edge of the printing paper supporting surface by projecting upward from the printing paper supporting surface, and a stencil master plate supporting member for supporting a planar stencil master plate is placed above and opposite to the printing paper supporting surface. Further provided is a pressure applying unit for pressing the printing paper supporting table against a stencil master plate supporting member. Thus, the feeding of printing paper to the printing paper supporting table, the positioning of the printing paper thereon, and the removal of the printing paper from the printing paper supporting table after printing can be conveniently automatized by using a simple structure without requiring any complex printing paper feeding mechanism or printing paper removing mechanism.

9 Claims, 7 Drawing Sheets

PRESSURE PRINTING DEVICE

TECHNICAL FIELD

The present invention relates to a pressure printing device such as a stencil printing device, and in particular to a pressure printing device which can be automatized without requiring any complex and expensive structures.

BACKGROUND OF THE INVENTION

According to a known pressure printing device using a planar stencil master plate of a simple type for home and office use, a printing paper support table is placed on a base, and a planar stencil master plate is placed on a pivoted pressure plate which can pivot vertically with respect to the base by means of a hinge so that the stencil printing may be accomplished by the pivoting movement of the pressure plate which causes the stencil master plate mounted on the pivoted pressure plate to be pressed against the printing paper placed on the printing paper supporting table.

In such a simple pressure printing device, the placement and positioning of printing paper on the printing paper supporting table and the removal of the printing paper from the printing paper supporting table are carried out manually. If it is to be automated, significantly complex paper feed mechanism and paper removal mechanism will be necessary. It means that such an automated printing device will be so complex and bulky that it will be unsuitable for use in offices and homes.

BRIEF SUMMARY OF THE INVENTION

The present invention was made in view of such problems of the conventional printing device, and its primary object is to provide a pressure printing device such as a stencil printing device which can be automated with regard to the feeding and positioning of printing paper to and on a printing paper supporting table and removing of printing paper, after completion of printing, from the printing paper supporting table without requiring any complex paper feeding mechanism or paper removal mechanism.

A second object of the present invention is to provide a pressure printing device which is capable of reliable operation particularly in regard to the feeding of the printing paper onto and away from the printing paper support surface where the printing is actually carried out.

A third object of the present invention is to provide a pressure printing device which is capable of superimposition printing for color printing through automatization of the feeding and positioning of printing paper to and on a printing paper supporting table and removing of printing paper, after completion of printing, from the printing paper supporting table in a simple manner.

According to the present invention, such an object can be accomplished by providing a pressure printing device, comprising: printing paper supporting table having a printing paper supporting surface which is angled with respect to a horizontal plane so as to allow feeding of printing paper under the gravitational force and provided with an adhesive property for retaining printing paper thereon; peeling means for separating printing paper adhered to the printing paper supporting surface from the printing paper supporting surface; gate means for preventing a downward movement of printing paper along the printing paper supporting surface by being placed on a lower edge of the angled printing paper supporting surface, and selectively projecting above the printing paper supporting surface; master plate supporting means placed above the printing paper supporting surface in an opposing relationship for supporting a planar master plate; and pressure means for pressing the printing paper supporting surface of the printing paper supporting table against the master plate supported by the master plate supporting means.

According to such a structure, the printing paper is allowed to fall along an angled plane under the gravitational force onto the printing paper supporting surface of the printing paper supporting table, and this movement is stopped by the gate means so that the printing paper may be properly received on the printing paper supporting surface at a proper position.

The printing paper which has adhered to the printing paper supporting surface as a result of pressure printing is removed from the printing paper supporting surface by the peeling means, and the opening of the gate member causes the printing paper to fall from the printing paper supporting surface along an angled plane under the gravitational force, so that the printing paper may be removed from the printing paper supporting table in a convenient manner.

The pressure printing device according to the present invention may further comprise automatic paper feeding means placed on the upper edge of the printing paper supporting surface for feeding printing paper sheet by sheet to the printing paper supporting surface by the downward movement of the printing paper under the gravitational force on the angled printing paper supporting surface.

According to a preferred embodiment of the present invention, the master plate supporting means consists of a fixed member while the printing paper supporting table consists of a moveable table which can be moved by the pressure means toward and away from the master plate supporting means to be selectively pressed against a part of the master plate supported by the master plate supporting means. In this case, the peeling means may comprise a plurality of peeling members which are moveable between a first position located above the printing paper supporting surface and a second position located below the printing paper supporting surface, and actuating means for moving the peeling members between the first and second positions, and the actuating means comprises spring means for urging the peeling members toward the second position, 10 and abutting means which moves the peeling members to the first position by abutting a part of the peeling members as the printing paper supporting table is moved away from the master plate supporting means. Thus, the movement of the printing paper supporting table can be utilized for the operation of the peeling means, and this contributes to the simplification of the structure and the improvement of reliability.

Further, to achieve similar goals, the gate means may comprise a stopper tab member for determining the position of an edge the printing paper which is moveably supported by the printing paper supporting table, spring means urging the stopper tab member to a position projecting from the printing paper supporting surface, and an actuator for selectively moving the stopper tab member down below the printing paper supporting surface.

For superimposition printing which may be typically employed for full color printing, the present invention provides a pressure printing device, comprising: a plurality of printing paper supporting tables each provided with a printing paper supporting surface angled in a first direction with respect to a horizontal plane so as to allow feeding of printing paper in the first direction under the gravitational force and having an adhesive property for retaining printing paper thereon arranged in a row extending in the first direction along a substantially common plane; printing paper guide means provided between each adjacent two of the printing paper supporting tables for guiding a downward movement of the printing paper to the following printing paper supporting surface under the gravitational force; peeling means provided in each of the printing paper supporting tables for selectively removing the printing paper adhering to the printing paper supporting surface from the printing paper supporting surface; gate means arranged on a lower edge of the printing paper supporting surface of each of the printing paper supporting tables for preventing a downward movement of the printing paper by selectively projecting upward from the printing paper supporting surface; master plate supporting means provided above each of the printing paper supporting surfaces opposite to the printing paper supporting surface for supporting a planar master plate; and pressure means for selectively pressing the printing paper supporting surface of each of the printing paper supporting tables against the master plate supported by the master plate supporting means.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
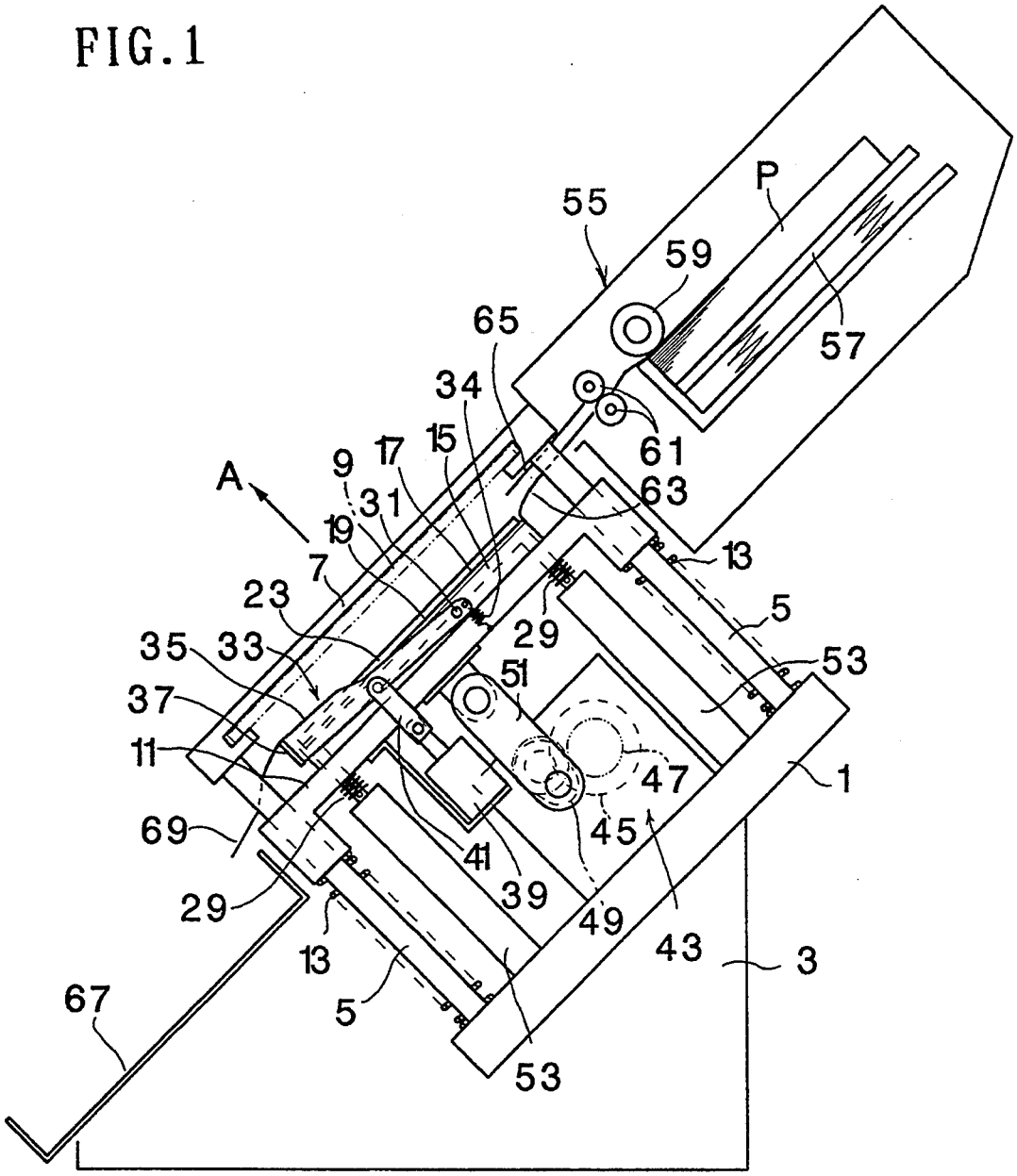
FIG. 1 is a side view showing an initial condition of an embodiment of the pressure printing device according to the present invention.
Figure 2:
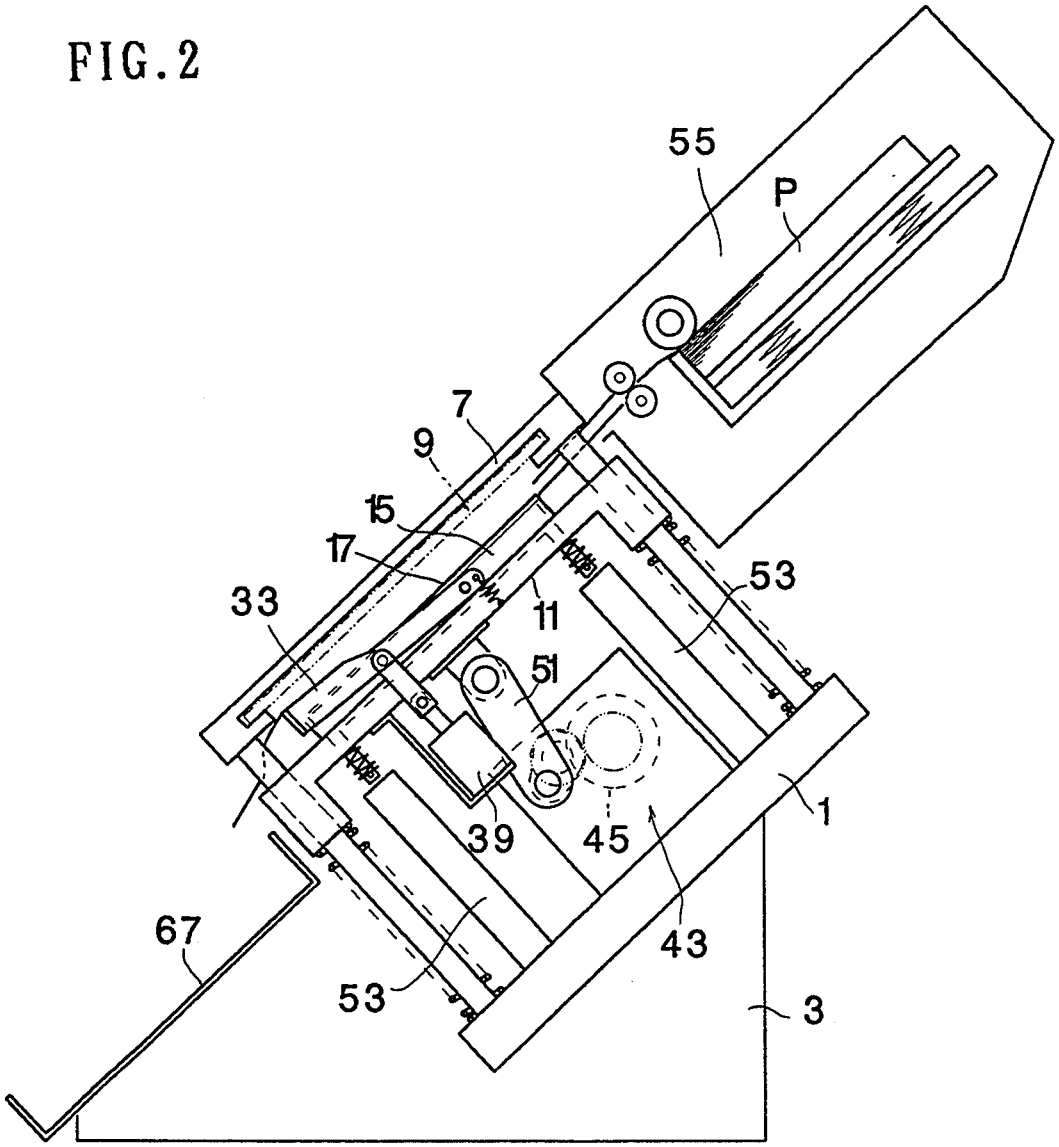
FIG. 2 is a side view showing an intermediate condition of the embodiment of the pressure printing device according to the present invention.
Figure 3:
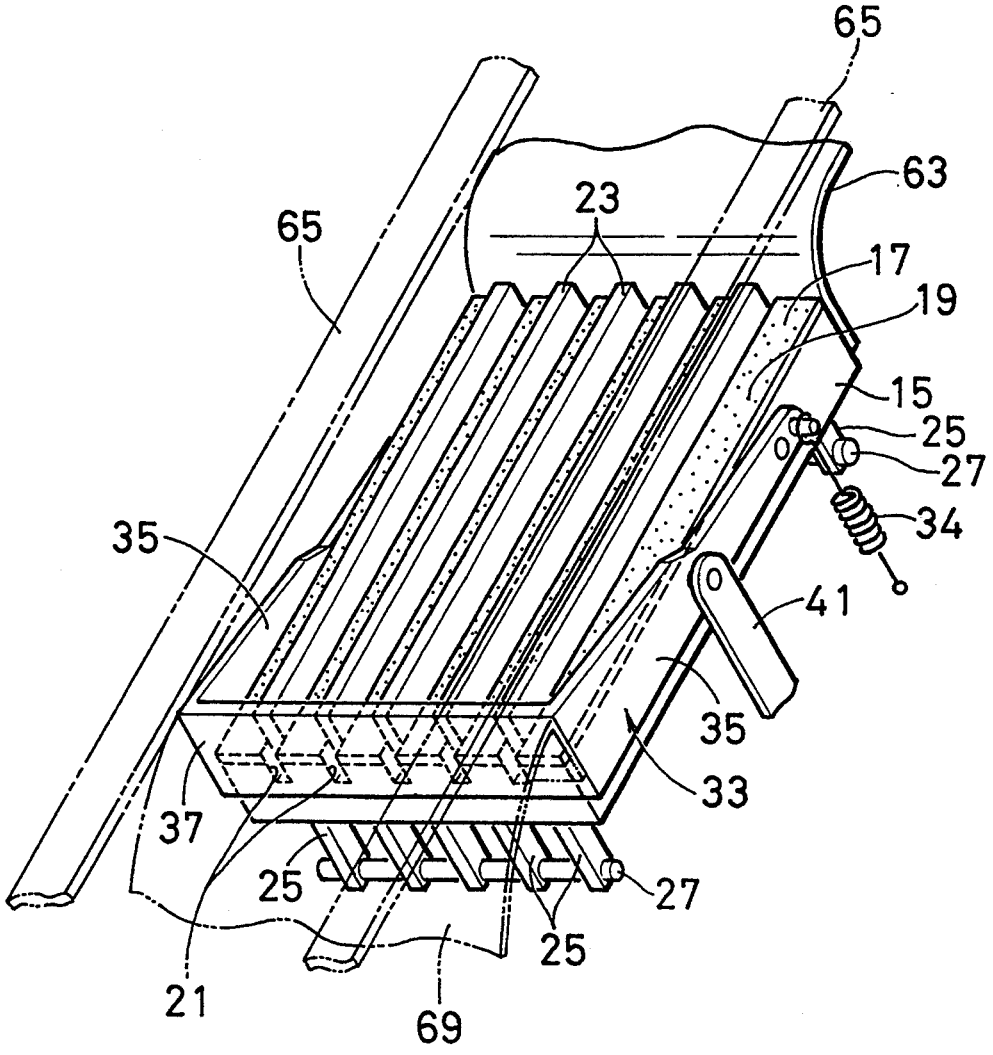
FIG. 3 is a perspective view showing a part related to the printing paper supporting table of the printing unit which is used in the embodiment of the pressure printing device according to the present invention.

FIGS. 1 through 3 show a first embodiment of the pressure printing device according to the present invention. In these drawings, numeral 1 denotes a base which is vertically inclined with respect to a mounting frame 3. The base 1 is provided with guide posts 5 which extend vertically from the inclined upper surface of the base 1.

The free end of each of the guide posts 5 is fixedly secured to a stencil master plate supporting member 7 for securing the same in parallel with the inclined upper surface of the base 1. The stencil master plate supporting member 7 is adapted to replaceably carrying a stencil master plate holder 9 in parallel with the inclined upper surface of the base 1. The stencil master plate holder 9, for instance, may consist of a frame and a stencil master plate stretched across the frame as disclosed in Japanese utility model laid open publication (kokai) No. 51-132007.

The guide posts 5 engage a moveable table 11 so as to be slidable in the axial direction of the guide posts 5 while maintaining a parallel angular relationship, and the moveable table 11 is urged upward or in the direction indicated by arrow A in FIG. 1 (hereinafter, this direction is simply referred to as "upward", and the term "upward" used in this specification should be understood as indicating the direction indicated by arrow A.) along the axial direction of the guide posts 5 by compression coil springs 13.

The moveable table 11 carries a printing paper supporting table 15 fixedly thereon, and the upper surface of the printing paper supporting table 14 is defined as a printing paper supporting surface 17 which is vertically inclined in parallel with the inclined upper surface of the base 1. As a result, the stencil master plate supporting member 7 or, in other words, the stencil master plate carried by the stencil master plate holder 9 which is in turn supported by the stencil master plate supporting member 7 opposes the printing paper supporting surface 17 in mutually parallel relationship. The inclination angle of the printing paper supporting surface 17 is so defined that the printing paper P may slide down along the printing paper supporting surface 17 under the gravitational force, and may range between 30 and 60 degrees with respect to the horizontal plane.

The printing paper supporting surface 17 consists of an adhesive layer 19 having an adhesive property for retaining printing paper P thereon by adhesion. This adhesive layer 19 consists of an adhesive resin material such as adhesive polyurethane resin and adhesive rubber material, and reference should be made to Japanese utility model laid open publication (kokai) No. 62-15725 for the details of possible materials for the adhesive layer 19.

As best illustrated in FIG. 3, the printing paper supporting table 15 is provided with a plurality of slit-like slots 21 extending in the direction of inclination in a mutually spaced apart relationship in the direction perpendicular to the direction of inclination. A peeling plate 23 is engaged with each of the slit-like slot 21 in a vertically moveable manner. Each of the peeling plates 23 can moved between an upper position in which the peeling plate 23 projects out of the printing paper supporting surface 17 as illustrated in FIGS. 1 and 3, and a lower position in which the peeling plate 23 does not project out of the printing paper supporting surface 17 as illustrated in FIG. 2. The peeling plates 23 are joined at their leg portions 25 with one another by connecting rods 27 so as to move integrally with one another between the upper position and the lower position, and are biased upward by compression coil springs 29 provided in association with the leg portions 25.

A gate member 33 is vertically rotatably supported by the printing paper supporting table 15 by means of a pivot shaft 31. The gate member 33 is provided with the shape of a staple comprising a pair of side tabs 35 extending along on either side of the printing paper supporting surface 17 and a lower tab 37 extending along the lower edge of the inclined printing paper supporting surface 17, and is rotatable between a closed position for preventing the falling of the printing paper P by being placed above the peeling plates 23 at their upper position and an open position for allowing the falling of the printing paper by being placed above the peeling plates 23 at the upper position.

The gate member 33 is biased toward its closed position by a spring 34, and is driveably coupled, via a link member 41, to a solenoid device 39 mounted on the moveable table 11 so as to be selectively driven to its open position.

The base 1 is provided with a vertical drive unit 43 for the printing paper supporting table 11. The vertical drive unit 43 comprises a motor 45, and a drive lever 49 which can be rotatively driven by the motor 45 via a gear train 47, and the drive lever 49 is driveably connected to the moveable table 11 via a link member 51.

The moveable table 11 can be driven by the motor 45 vertically as defined in this specification along the axial direction of the guide posts 5 between the upper position in which the printing paper supporting surface 17 of the printing paper supporting table 15 is moved downward away from the stencil master plate supporting member 7 and a lower position in which the printing paper supporting surface 17 of the printing paper supporting table 15 is pressed against the surface of the stencil master plate carried by the stencil master plate holder 9 which is in turn supported by the stencil master plate supporting member 7.

The base 1 carries a peeling plate abutting member 53 fixedly secured thereon which abuts the leg portions 25 of the peeling plates 23 when the moveable table 11 is located adjacent to its lower position so that the peeling plates 23 may be placed at their upper position against the spring force of the compression coil spring 29 by the downward relative movement of the moveable table 11.

Thus, the peeling plates 23 are always located at their upper position whenever the moveable table 11 is at its lower position, and the peeling plates 23 are placed at their lower position by the spring force of the compression coil spring 29 when the moveable table 11 has been lifted by more than a prescribed distance from its lower position.

An automatic paper feeding device 55 is arranged on the upstream end of the printing paper supporting table 15 as seen in the direction of inclination. The automatic paper feeding device 55 may consist of a per se known type, comprising a printing paper table 57 for placing a stack of printing paper P thereon, a paper separating roller 59, and paper feeding rollers 61, and feeds out the printing paper P to the printing paper supporting surface 17 sheet by sheet by letting each sheet of printing paper freely fall along an inclined plane under the gravitational force.

Between the printing paper outlet defined by the feeding rollers 61 of the automatic paper feeding device 55 and the printing paper supporting table 15 is provided a flexible guide member 63 which is made of such material as Mylar film and connected to the printing paper outlet mentioned above at its one end and to the upper edge of the inclined printing paper supporting table 15 at its other end. Another flexible guide member 65 also consisting of Mylar film or the like is placed above the flexible guide member 63.

The downstream end of the inclined printing paper supporting table 15 is provided with a paper ejection table 67 for supporting printed printing paper. Between the printing paper supporting table 15 and the paper ejection table 67 is provided a flexible guide member 69 which is made of such material as Mylar film and connected to the lower tab 37 of the gate member 33 at its one end and to a position above the paper ejection table 67 at its other end.

The upper flexible guide member 65 may consist of a pair of bands extending along either inclined side of the printing paper supporting table 15 to a region adjacent to a terminal end of the flexible guide member 69 so as not to obstruct the printing process conducted on the printing paper supporting table 15 as illustrated in FIG. 3.

In the above description, it should be noted that the angle of the printing paper supporting surface is required to be such as to allow the printing paper to be conveyed under the gravitational force. Therefore, the inclination angle may be arbitrary as long as the feeding of the paper may be effected substantially solely by the gravitational forge with the understanding that assisting the feeding movement of the printing paper by power means should be understood to be within the concept of the present invention. Conversely, the inclination angle may be as great as 90 degrees.

According to the above described structure, the printing paper P is fed onto the printing paper supporting table 15 by the automatic paper feeding device 55 sheet by sheet. The printing paper P is guided by the flexible guide members 63 and 65, and falls onto the printing paper supporting table 15 along an inclined plane under the gravitational force.

When the printing paper is thus being received, the printing paper supporting table 15 is at its lower position along with the moveable table 11 as illustrated in FIG. 1, and the peeling plates 23 are at their upper position in a corresponding manner. Therefore, the printing paper P slides over the inclined upper end surface of the peeling plates 23 extending along an inclined plane encountering a relatively small resistance onto the printing paper supporting table 15, guided by the two side tabs 35 of the gate member 33. The printing paper P eventually abuts the lower tab 37 of the gate member 33 at its closed position, and is prevented from dropping any further.

Thus, the terminal position of the printing paper P as it slides down the inclined plane of the peeling plates 23 is determined by the abutting of the printing paper onto the lower tab 37 of the gate member 33, and the lateral position of the printing paper P on the peeling plates 23 is determined by the side tabs 35 of the gate member 33 so that the printing paper P is ultimately placed in the prescribed printing position.

Then, the moveable table 11 is drivingly lifted by the motor 47, and the leg portions 25 of the peeling plates 23 are moved away from a peeling plate abutting member 53 as illustrated in FIG. 2 in a corresponding manner so that the peeling plates 23 are lowered relative to the printing paper supporting table 15 to their lower position by the spring force of the compression coil springs 29. This downward movement of the peeling plates 23 causes the printing paper P on the peeling plates 23 to be placed on the printing paper supporting surface 17, and with the moveable table 11 being drivingly lifted further, the moveable table 11 ultimately attains its highermost position at which the printing paper P on the printing paper supporting surface 17 is engaged with and pressed against the surface of the stencil master plate carried by the stencil master plate holder 9 which is in turn supported by the stencil master plate supporting member 7.

This pressure effects a stencil printing on the printing paper P, and this pressure also presses the printing paper P against the adhesive layer 19 of the printing paper supporting surface 17 so as to retain the printing paper P thereon.

At this time, the gate member 33 is moved to its closed position against the spring force of the springs 34 by being engaged by the frame portion of the stencil master plate holder 9 or the like, but since the printing paper P is in engagement with the surface of the stencil master plate carried by the stencil master holder 9 and is retained by the adhesive layer 19, the position of the printing paper P would not be changed and the printing paper would not drop off from the printing paper supporting surface 17.

As the motor 47 is further driven, the moveable table 11 moves on from its upward movement to its downward movement along with the printing paper supporting table 15, and this releases the pressing of the printing paper P on the printing paper supporting surface 17 against the stencil master plate, and the printing paper P still retained by the printing paper supporting surface 17 by being adhered to the adhesive layer 19 moves away from the stencil master plate. Thereby, the printing paper P is lowered along with the printing paper supporting table 15. This downward movement causes the gate member 33 to be disengaged from the frame of the like of the stencil master plate holder 9, and is automatically returned to its closed position by the spring force of the springs 34.

When the moveable table 11 is lowered to a position adjacent to its lower position, the legs 25 of the peeling plates 23 come into engagement with the peeling plate abutting member 43, and the peeling plates 23 are projected upward from the printing paper supporting surface 17 by this upward movement of the peeling plates 23, and the printed printing plate P adhering to the printing paper supporting surface 17 is thereby lifted, and removed from the adhesive layer 19.

When the moveable table 11 has finally returned to its lower position, the gate member 33 is forced to its open position by the solenoid device 39. As a result, the printed printing paper on the printing paper supporting surface 17 slides over the upper end surface of the peeling plates 23 under the gravitational force encountering a relatively small resistance, and is thereby immediately removed from the printing paper supporting table 15. The printing paper P slides over the flexible guide member 69, and is deposited on the paper rejection table 67 into a stack.

Thereafter, new printing paper P is fed onto the printing paper supporting table 15 by the automatic paper feeding device 55, and the above described process is repeated. Thus, a plurality of sheets of printing paper P placed on the printing paper table 57 are printed by being automatically fed and ejected in a continuous manner.

Figure 4:
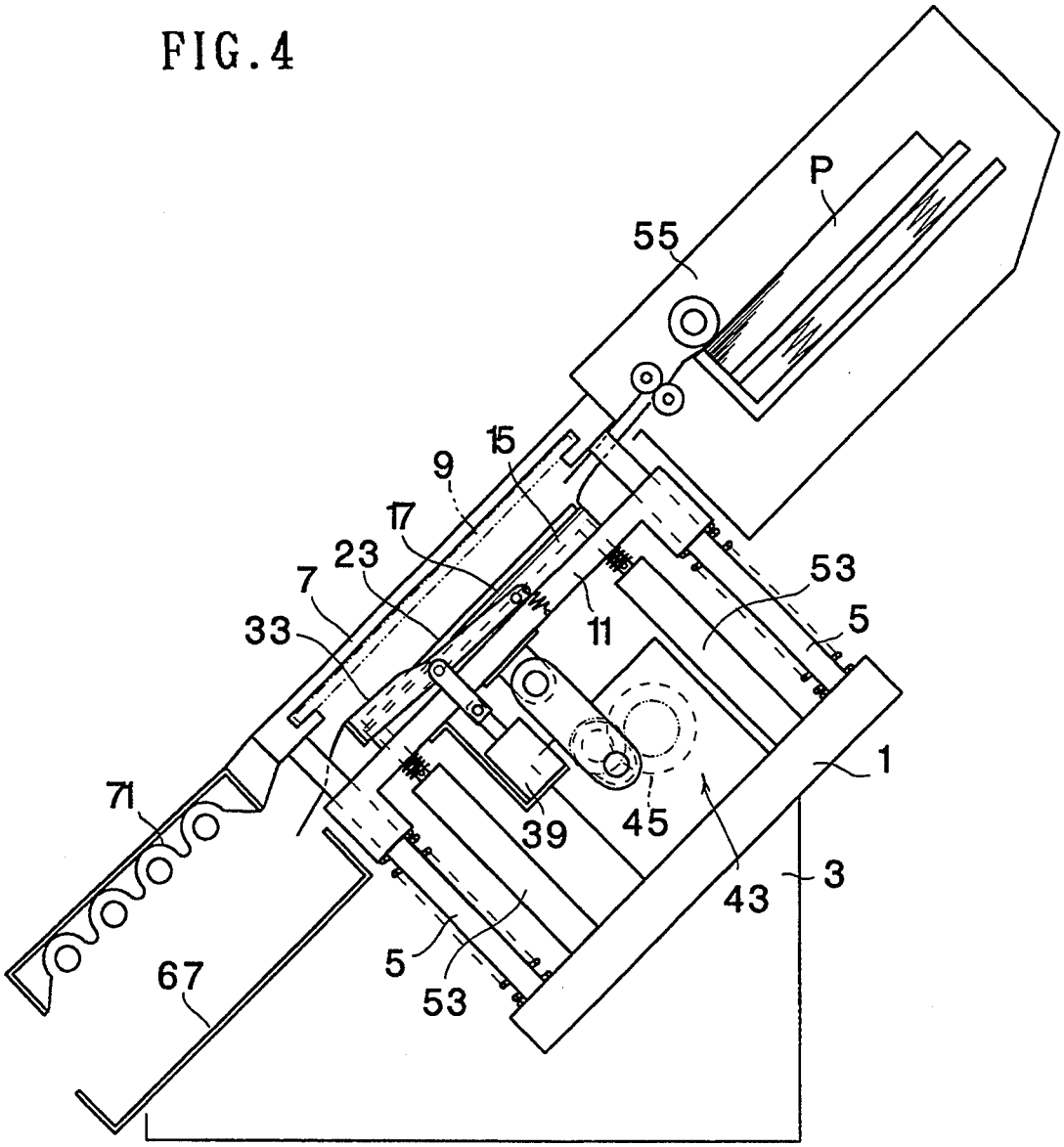
FIG. 4 is a side view showing another embodiment of the pressure printing device according to the present invention.

In such a continuous printing process, the printed printing paper P is stacked on the paper ejection table 67 with its printed side up. Therefore, if the printing ink deposited on the printed printing paper P may be still wet, and there is a possibility of offsetting or smearing of the reverse surface of the printing paper due to the wet ink deposited on the underlying sheet of the printing paper P, a heater unit 71 may be provided above the paper ejection table 67 as illustrated in FIG. 4.

Figure 5:
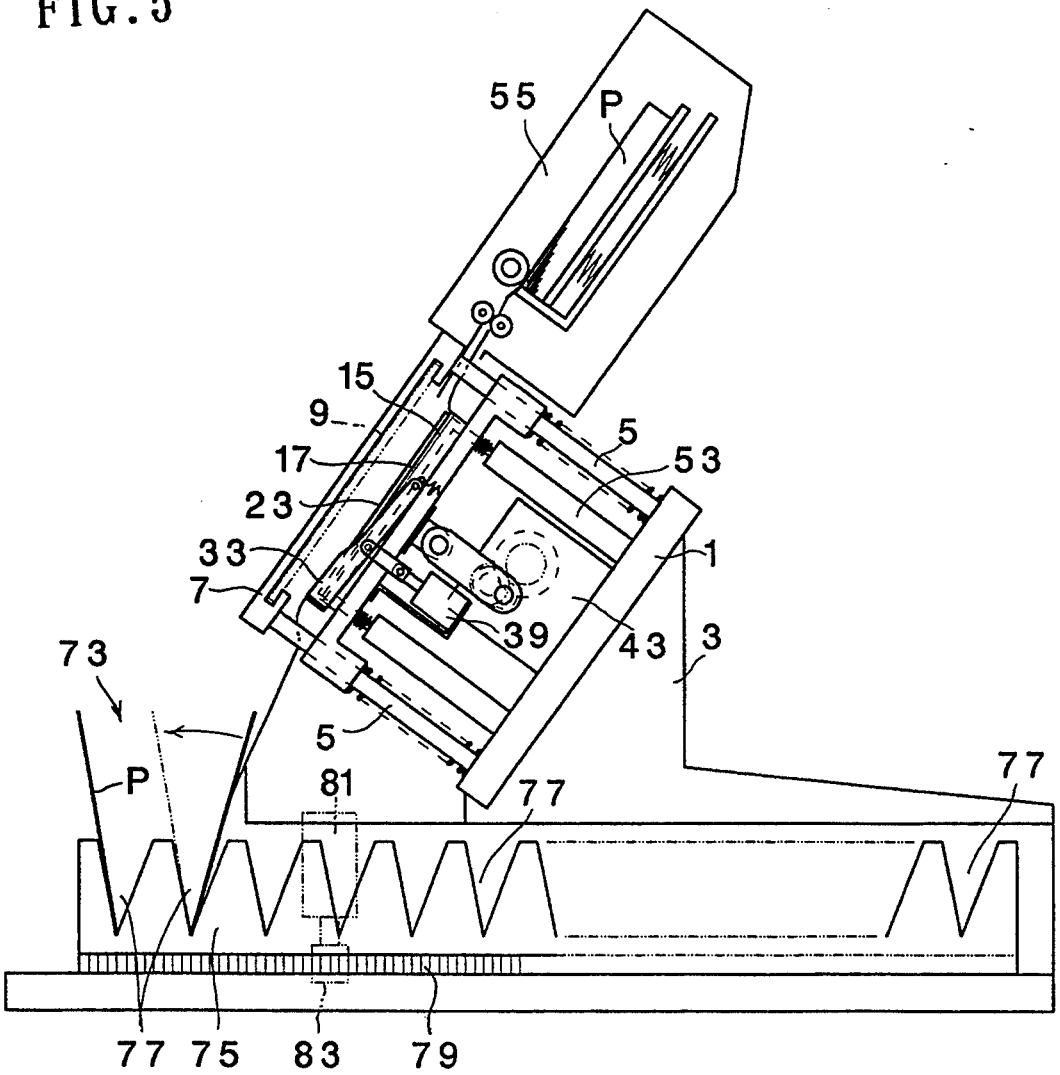
FIG. 5 is a side view showing yet another embodiment of the pressure printing device according to the present invention.
Figure 6:
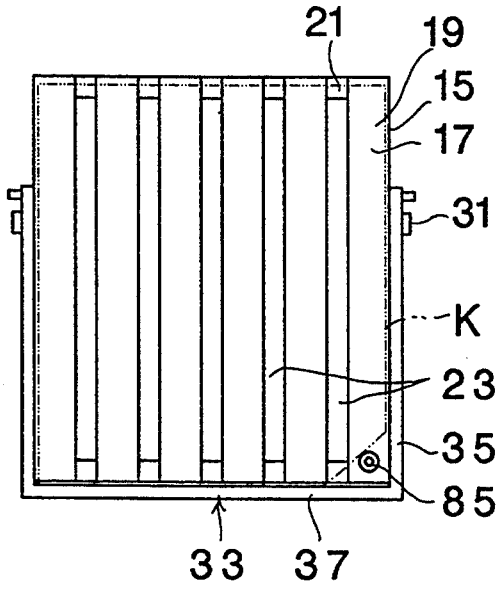
FIG. 6 is a perspective view showing another embodiment of the part related to the printing paper supporting table of the printing unit which is used in the embodiment of the pressure printing device according to the present invention.

FIG. 5 shows another embodiment of the pressure printing device according to the present invention. In FIG. 5, the parts corresponding to those of FIG. 1 are denoted with like numerals.

In this embodiment, a printing paper stand device 73 is placed at the upstream end of the printing paper supporting table 15 as seen in the direction of inclination, instead of the paper ejection table 67.

The printing paper stand device 73 is provided with a laterally moveable stand member 75 as seen in FIG. 5 which is provided with a plurality of recesses arranged at equal interval for receiving the printed printing paper P coming down, under the gravitational force, from the printing paper supporting table 15 along an inclined plane guided by the flexible guide member 69 sheet by sheet.

The moveable stand member 75 is provided with a rack 79 with which a pinion 83 rotatively driven by a motor 81 meshes. The pinion 83 advances the moveable stand member 75 according to the pitch of the recesses after printing each sheet of printing paper P by being indexed by the motor 81 and meshing with the rack 79.

Thus, the printed printing paper P drops into each of the recesses 77 of the moveable stand member 75 one sheet at a time so as to separate the printed printing paper one sheet from another and prevent the offsetting.

To prevent the offsetting, it is also possible to interleave a separator sheet K which is not to be printed between each pair of adjacent sheets of printed printing paper P on the printing paper table 57 of the automatic paper feeding device 55, and to carry out the printing process when a sheet of printing paper P is fed out but, when a separator sheet K is fed from the automatic paper feeding device 55, let the separator sheet K pass through the printing paper supporting table 15 and be directly ejected onto the paper ejection table 67 by moving the gate member 33 to its open position.

Figure 7:
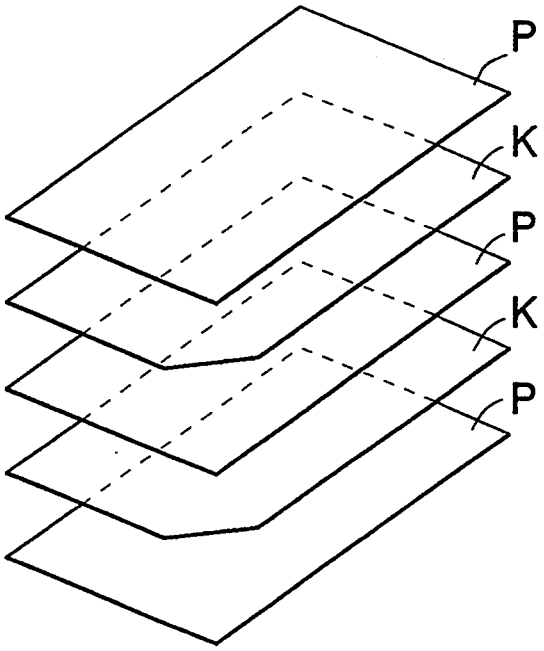
FIG. 7 is a perspective view showing how the printing paper sheets and the separator sheets are interleaved in the pressure printing device according to the present invention.

In this case, to automatically distinguish whether the paper fed onto the printing paper supporting table 15 is a sheet of normal printing paper P or a separator sheet K, a photoelectric sensor 85 is provided on one corner portion of the printing paper supporting table 15, and using separator sheets K each having one corner portion corresponding to the position of the photoelectric sensor 85 clipped off as illustrated in FIG. 7.

Figure 8:
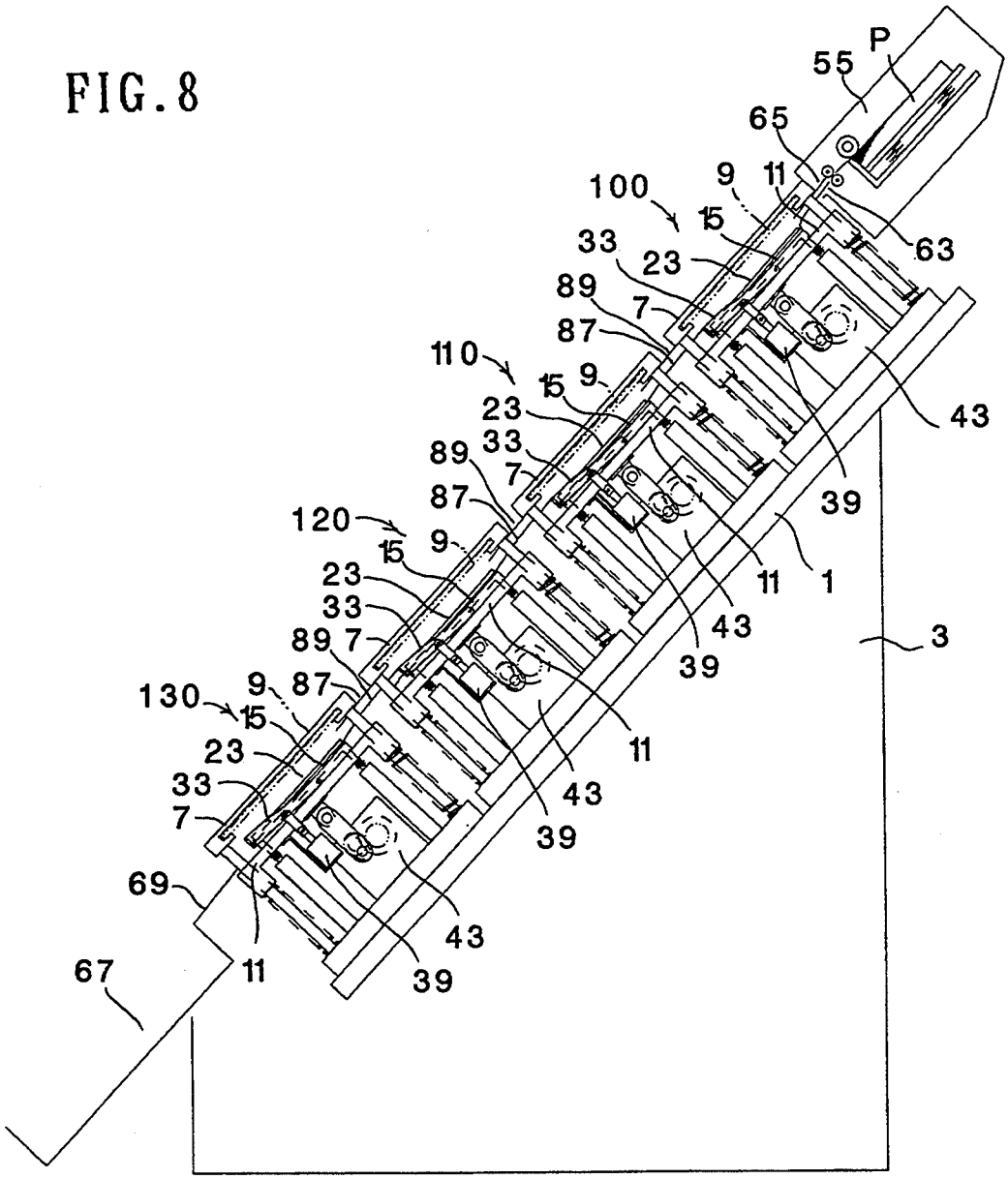
FIG. 8 is a side view showing yet another embodiment of the pressure printing device according to the present invention.

FIG. 8 shows yet another embodiment of the pressure printing device according to the present invention. In FIG. 8, the parts corresponding to those of FIG. 1 are denoted with like numerals.

In this embodiment, as denoted with numerals 100, 110, 120 and 130, four printing units are arranged along a vertically inclined plane in a single row, and the uppermost printing unit 100 is provided with an automatic paper feeding device 55 on its upstream end as seen in the direction of inclination, and the lowermost printing unit 130 is provided with a paper ejection table 67 on its downstream end.

Each of the four printing units 100, 110, 120 and 130 is constructed in the same way as the pressure printing device illustrated in FIG. 1, and can individually conduct a stencil printing process.

In other words, the four printing units 100, 110, 120 and 130 are arranged in such a manner that four printing paper supporting tables 15 each having a vertically inclined printing paper supporting surface 17 are arranged in a single row along the direction of inclination, with each of the printing paper supporting table 15 being individually provided with a set of separating plates 23 and a gate member 33, and a stencil master plate supporting member 7 is placed above the printing paper supporting surface 17 of each of the printing paper supporting tables 15 so as to directly oppose the printing paper supporting surface 17 thereof.

Between each pair of adjacent printing paper supporting tables 15 is provided a flexible guide member 87 made of Mylar film or the like for guiding the downward sliding movement of the printing paper P from one printing paper supporting surface 17 to another with its one end connected to a lower tab 87 of the gate member 33 of the preceding printing unit and its other end connected to the upper edge of the next printing paper supporting table 15.

The flexible guide member 89 may extend only along either side of each of the corresponding printing paper supporting tables 15 all the way from the first to the fourth printing units 100 through 130, in the same way as the flexible guide member 65.

In this case, as the automatic paper feeding device 55 and the printing units 100, 110, 120 and 130 operate in the same way as the counterparts in the previous embodiment, the printing paper P is automatically supplied to the printing units 100, 110, 120 and 130 under the gravitational force along the respective inclined planes, and a superimposition printing process is carried out in the four printing units 100, 110, 120 and 130, in a sequential manner.

As a result, by using the printing inks of yellow, magenta, cyan and black colors in the respective printing units 100, 110, 120 and 130, a full color printing process can be accomplished.

In this case, the positioning of the printing paper P in each of the four printing units 100, 110, 120 and 130 is carried out by the corresponding gate member 33 as described in conjunction with the preceding embodiment.

In this process of positioning the printing paper P, when it is desired to precisely position the printing paper P with respect to the lateral direction by using the side tabs 35 of the gate member 33, the printing paper supporting table 17 of each of the printing units 100, 110, 120 and 130 may be inclined in this direction so as to have a three-dimensional inclination.

As can be understood from the above description, according to the pressure printing device of the present invention, feeding of printing paper P to the printing paper supporting table as well as the positioning of the printing paper thereon is carried out by the printing paper being dropped onto the printing paper supporting surface of the printing paper supporting table along an inclined plane under the gravitational force and being received and stopped on the printing paper supporting surface by the gate member, and the printing paper which has adhered to the printing paper supporting surface as a result of a process of pressure printing is removed from the printing paper supporting surface by the peeling means so that the printing paper may be removed from the printing paper supporting surface, when the gate member is opened up, along an inclined plane under the gravitational force. Therefore, the feeding of printing paper P to the printing paper supporting table, the positioning of the printing paper thereon, and the removal of the printing paper from the printing paper supporting table after printing can be carried out in a reliable fashion without requiring any complex printing paper feeding mechanism or printing paper removing mechanism. Further, the present invention allows the feeding of printing paper P to the printing paper supporting table, the positioning of the printing paper thereon, and the removal of the printing paper from the printing paper supporting table after printing to be carried out in a simple manner in a superimposition printing process for full color printing or the like.

Although the present invention has been described in terms of specific embodiments thereof, it is possible to modify and alter details thereof without departing from the spirit of the present invention.

What we claim is:

1. A pressure printing device, comprising;

printing paper supporting table having a printing paper supporting surface which is angled with respect to a horizontal plane so as to allow feeding of printing paper along said printing paper supporting surface under the gravitational force and provided with an adhesive property for retaining printing paper thereon;

peeling means for separating printing paper adhered to said printing paper supporting surface from said printing paper supporting surface;

gate means for preventing a downward movement of printing paper along said printing paper supporting surface by being placed on a lower edge of said angled printing paper supporting surface, and selectively projecting above said printing paper supporting surface;

master plate supporting means placed above said printing paper supporting surface in an opposing relationship for supporting a planar master plate; and pressure means for pressing said printing paper supporting surface of said printing paper supporting table against said master plate supported by said master plate supporting means.

2. A pressure printing device according to claim 1, further comprising automatic paper feeding means placed adjacent to an upper edge of said printing paper supporting surface for feeding printing paper sheet by sheet to said printing paper supporting surface by a downward movement of said printing paper under the gravitational force on said angled printing paper supporting surface.

3. A pressure printing device according to claim 1, said master plate supporting means consists of a fixed member while said printing paper supporting table consists of a moveable table which can be moved by said pressure means toward and away from said master plate supporting means to be selectively pressed against said master plate supported by said master plate supporting means.

4. A pressure printing device according to claim 1, wherein said peeling means comprises a plurality of peeling members which are moveable between a first position located above said printing paper supporting surface and a second position located below said printing paper supporting surface, and actuating means for moving said peeling members between said first and second positions.

5. A pressure printing device according to claim 3, wherein said peeling means comprises a plurality of peeling members which are moveable between a first position located above said printing paper supporting surface ana a second position located below said printing paper supporting surface, and actuating means for moving said peeling members between said first and second positions, and said actuating means comprises spring means for urging said peeling members toward said second position, and abutting means which moves said peeling members to said first position by abutting a part of said peeling members as said printing paper supporting table is moved away from said master plate supporting means.

6. A pressure printing device according to claim 1, wherein said gate means comprises a stopper tab member for determining the position of an edge the printing paper which is moveably supported by said printing paper supporting table, spring means urging said stopper tab member to a position projecting from said printing paper supporting surface, and an actuator for selectively moving said stopper tab member down below said printing paper supporting surface.

7. A pressure printing device according to claim 1, wherein said master plate consists of a stencil master plate.

8. A pressure printing device, comprising;

a plurality of printing paper supporting tables each provided with a printing paper supporting surface angled with respect to a horizontal plane in a first direction so as to allow feeding of printing paper along said printing paper supporting surface under the gravitational force in said first direction and having an adhesive property for retaining printing paper thereon arranged in a row extending in said first direction along a substantially common plane;

printing paper guide means provided between each adjacent two of said printing paper supporting tables for guiding a downward movement of said printing paper to the following printing paper supporting surface under the gravitational force;

peeling means provided in each of said printing paper supporting tables for selectively removing the printing paper adhering to said printing paper supporting surface from said printing paper supporting surface;

gate means arranged on a lower edge of the printing paper supporting surface of each of said printing paper supporting tables for preventing a downward movement of said printing paper by selectively projecting upward from said printing paper supporting surface;

master plate supporting means provided above each of said printing paper supporting surfaces opposite to said printing paper supporting surface for supporting a planar master plate; and pressure means for selectively pressing said printing paper supporting surface of each of said printing paper supporting tables against said master plate supported by said master plate supporting means.

9. A pressure printing device according to claim 8, wherein said master plate consists of a stencil master plate.

* * * * *